United States Patent [19]

Gartside et al.

[11] Patent Number: 4,663,019

[45] Date of Patent: May 5, 1987

[54] OLEFIN PRODUCTION FROM HEAVY HYDROCARBON FEED

[75] Inventors: Robert J. Gartside, Wellesley, Mass.; Axel R. Johnson, North Babylon, N.Y.; Joseph L. Ross, Houston, Tex.; Dennis A. Duncan, Sharon, Mass.

[73] Assignee: Stone & Webster Engineering Corp., Boston, Mass.

[21] Appl. No.: 587,906

[22] Filed: Mar. 9, 1984

[51] Int. Cl.[4] ..... C10G 57/00; C10G 9/32

[52] U.S. Cl. ..... 208/50; 208/127; 208/153; 208/108

[58] Field of Search ..... 208/50, 92, 93, 127, 208/161, 108, 152, 153, 168

[56] References Cited

U.S. PATENT DOCUMENTS

| | | | |
|---|---|---|---|
| 2,737,479 | 3/1956 | Nicholson | 208/50 |
| 2,776,727 | 1/1957 | Boisture | 208/127 |
| 2,873,244 | 2/1959 | Hemminger | 208/50 |
| 2,905,629 | 9/1959 | Smith et al. | 208/127 |
| 3,113,985 | 12/1963 | Metrailer | 208/127 |
| 3,193,486 | 7/1965 | Payne | 208/127 |
| 3,440,163 | 4/1969 | Hamner | 208/127 |
| 3,487,006 | 12/1969 | Newman et al. | 208/93 |
| 3,498,906 | 3/1970 | Bogart et al. | 208/50 |
| 3,878,088 | 4/1975 | Nahas et al. | 208/50 |
| 3,907,664 | 9/1975 | Janssen et al. | 208/92 X |
| 4,049,538 | 9/1977 | Hayashi et al. | 208/50 |
| 4,049,540 | 9/1977 | Veda et al. | 208/127 |
| 4,097,362 | 6/1978 | McKinney et al. | 208/127 X |
| 4,172,857 | 10/1979 | Pavilon | 208/127 X |
| 4,318,800 | 3/1982 | Woebcke et al. | 208/161 X |

*Primary Examiner*—Glenn Caldarola

*Attorney, Agent, or Firm*—Hedman, Gibson, Costigan & Hoare

[57] ABSTRACT

A process for producing olefins and gasoline from residual oil by thermally cracking a side cut fraction from a fractionation tower, quenching the cracked product with residual oil, producing coke from a portion of the quenched product and using a portion of the coke to provide reaction heat for the thermal cracking.

16 Claims, 6 Drawing Figures

OLEFIN PRODUCTION FROM HEAVY HYDROCARBON FEED

FIELD OF THE INVENTION

The invention relates to the production of olefins from hydrocarbon feedstock. More particularly, the present invention is directed to a process for producing useful fuels, such as gasoline and olefins from heavy hydrocarbon feed. Most specifically, the process of the present invention is directed to the production of olefins and gasoline from heavy hydrocarbon in a system combining low residence time thermal cracking of hydrocarbon to produce olefins and coking of heavy hydrocarbon feed.

DESCRIPTION OF THE PRIOR ART

Cracking of heavy hydrocarbon to produce useful products, such as olefins and fuels, has become of major interest in recent years.

Naturally occurring hydrocarbons have been cracked for many years to produce olefins and fuels such as gasoline. Typically, the lighter hydrocarbon feeds have been used as feedstocks. However, as the lighter hydrocarbons are being consumed, the industry has turned to the heavy hydrocarbons.

The heavier hydrocarbons are more difficult to crack because of the high content of coke precursors (asphaltenes, polynuclear aromatics material, etc.), heavy metal and sulfur.

Many efforts have been made to provide systems for cracking these heavy hydrocarbon feeds customarily identified as residual oils.

The term residual oils is used to comprise residual, reduced crude oils, vacuum resids, atmospheric tower obttoms, topped crudes and essentially all other hydrocarbons heavier than gas oils.

The various efforts to provide systems to crack residual oils include efforts to pretreat the residual oils to condition the oils for conventional cracking.

Among the efforts at pretreating heavy hydrocarbon feedstock are solvent deasphalting, fluid or delayed coking and hydrotreating.

Solvent deasphalting and fluid or delayed coking are essentially carbon rejection processes. As a result of the temperatures and residence times involved in these processes, substantial losses occur in the material boiling in the range of the initial feedstock and significant amounts of thermal degradation and rearrangement are also effected. Hydrotreating imposes a very expensive burden on the catalyst and the hydrogen in the feed.

SUMMARY OF THE INVENTION

An object of the present invention is to produce olefins from heavy hydrocarbon residual oils.

A further object of the present invention is to produce olefins and gasoline from heavy hydrocarbons and to use the coke produced from the heavy hydrocarbons as fuel within the system.

A still further object of the present invention is to use in a combination, a thermal cracking olefins plant and a coker system, wherein coke produced from heavy hydrocarbon feedstock is used both as a heat source and heat carrier for cracking in an olefin cracking system.

Another object of the invention is to use the residual oil as a direct quench oil for the effluent from the olefins cracking plant.

A still further object of the process of the invention is to produce coke with a minimum of sulfur contamination by coking in the presence of gas containing olefins.

To this end, the process of the invention combines a thermal regenerative cracking (TRC) process with a coker—fractionation tower to crack residual oil.

In the process, after conventional start-ups, the residual oil is introduced into the system as a direct quench for the pyrolysis gas emanating from the TRC unit. The quenched pyrolysis gas is delivered to a fractionation tower from which the bottoms are passed to a coking plant to produce coke and coker distillates. The olefins and gasoline pass overhead from the fractionation tower.

A side cut from the fractionation tower is returned to the tubular low residence time reactor of the TRC unit for cracking to olefins and gasoline. A portion of the coke produced in the coking plant is returned for combustion in the TRC unit to provide heat to regenerate the particulate solids.

In a modification of the process, the TRC unit and a combined fractionation tower—coker are integrated. Rather than separate the pyrolysis gas and particulate solids, the residual oil is introduced into the discharge from the TRC reactor to quench both the solids and the pyrolysis gas. The entire stream is then sent to the coker of the fractionation tower—coker unit.

BRIEF DESCRIPTION OF THE DRAWINGS

The invention will be better understood when considered with the following drawings.

DESCRIPTION OF THE PREFERRED EMBODIMENT

The present invention is directed to a process for producing olefins from residual oils. The process produces coke from the residual oil which is used as a fuel for regenerating the solids used as the heat carrier in the olefins process. In one embodiment, the coke serves the dual function of both a fuel source and the solids heat carrier for thermally cracking the olefins.

Figure 1:
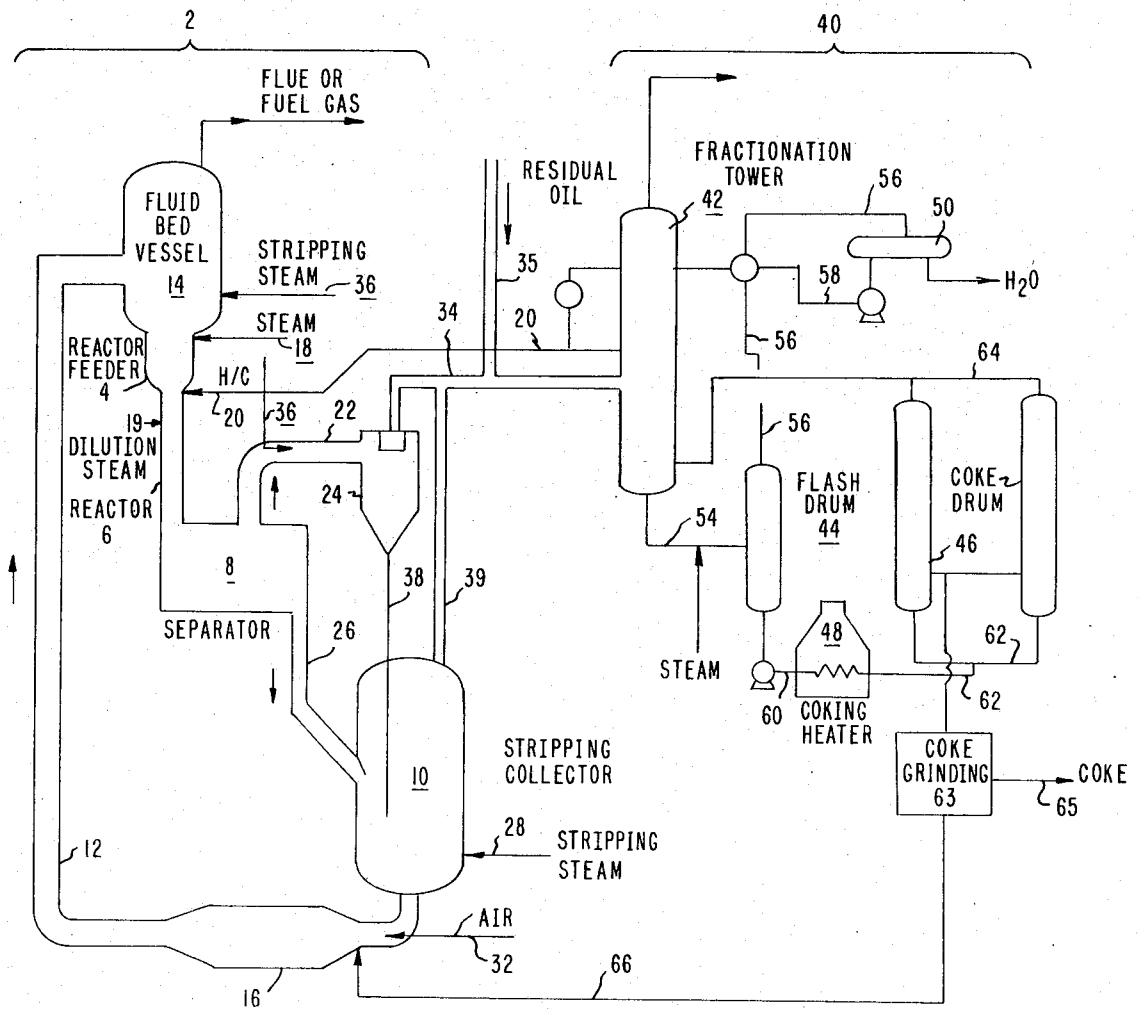
FIG. 1 is a schematic drawing of the combined delayed coker-thermal cracking system of the present invention.

As best seen in FIG. 1, the process of the present invention includes a system for cracking residual oil to produce olefins and gasoline. The system 2 for thermally cracking hydrocarbons to produce olefins, is comprised essentially of a reactor feeder 4, a reactor 6, a separator 8 for separating the reacted product and solids and means for regenerating the separated solids.

The means for regenerating the solids consists essentially of an entrained bed heater 16, a transfer line 12 to return the solids to the reactor feeder 4, and a fluid bed vessel 14 in which the regenerative solids repose prior to entry into the reactor 6.

The system also includes a stripper—collector 10 and cyclone 24. The stripper 10 collects the solids separated from the reacted product and stripping steam which enters the separator—collector 10 through a line 30 removes the hydrocarbon materials from the solids and returns the hydrocarbon materials to a product line 34 through line 39. The cyclone 24 is used to capture the entrained solids in the overhead product and return the solids to the stripper—collector 10.

The coker system 40 is comprised essentially of a fractionation tower 42, flash drum 44, coke drums 46 and and a coking heater 48.

The fractionation tower is conventional and is arranged for a temperature differential of 700° F. at the bottom and 350° at the top. The bottoms from the fractionation tower 42 pass through a line 54 to the flash drum 44 and further separate with the overhead passing through line 56 to a drum 50, wherein the water and steam are taken from the system and the remaining overhead from the flash drum 44 is returned to the fractionation tower 42, through a line 58. The bottoms from the flash drum 44 pass through a line 60 to the coking heater 48 wherein the temperature is elevated to 850°-930° F. to coking. The stream from the coking heater 48 is passed through line 62 to the coke drums 46, wherein the coking reaction continues (for one to three minutes) with coke deposited in the drums 46 and the overhead passes through line 64 to the fractionation tower 42. The coke collected in the coke drums 46 solidifies and is mechanically removed by conventional means. A portion of this stream is ground and returned through a line 66 to the entrained bed heater 16 in the olefin system 2.

In the process of the present invention, a cut of hydrocarbon from the fractionation tower 42 is passed through line 20 to the reactor feeder 4 (best seen in FIG. 4) for delivery to the reactor 6. Dilution steam is delivered to the reactor 6 through, line 19. Hot solids from the fluid bed vessel 14 are passed through the reactor feeder 4 to the reactor 6 to provide a heat source to crack the hydrocarbon. The cracked product and the solids pass through the separator 8 (best seen in FIG. 5) and are rapidly separated with the reaction product passing through an overhead line 22 and the solids passing through a line 26 to the stripper—collector 10. The overhead product in line 22 is initially partially quenched by a quench oil entering the product line 22 through line 36. The quenched product and entrained solids pass through the cyclone separator 24 wherein the entrained solids are removed and passed through the line 38 to the stripper—collector 10. The partially quenched reaction products travel through line 34 to the fractionation tower 42. In line 34, the reaction products are further directly quenched by residual oil entering the system through a line 35 which residual oil eventually provides a hydrocarbon source for producing olefins and coke.

In the process of the system, the particulate solids from bed 14 have been heated to a temperature of 1200° F. to 1800° F. The hydrocarbon entering the reactor 6 through line 20 is at a temperature of about 500°-700° F. The solids to hydrocarbon ratio by weight in the reactor 6 is 5 to 60, and the temperature of the product leaving the separator 8 overhead through line 22 is 1200° F. to 1600° F. After the initial quench the temperature is 1200° F.-1300° F. and upon quench with residual oil the temperature is reduced to approximately 700° F.

Figure 2:
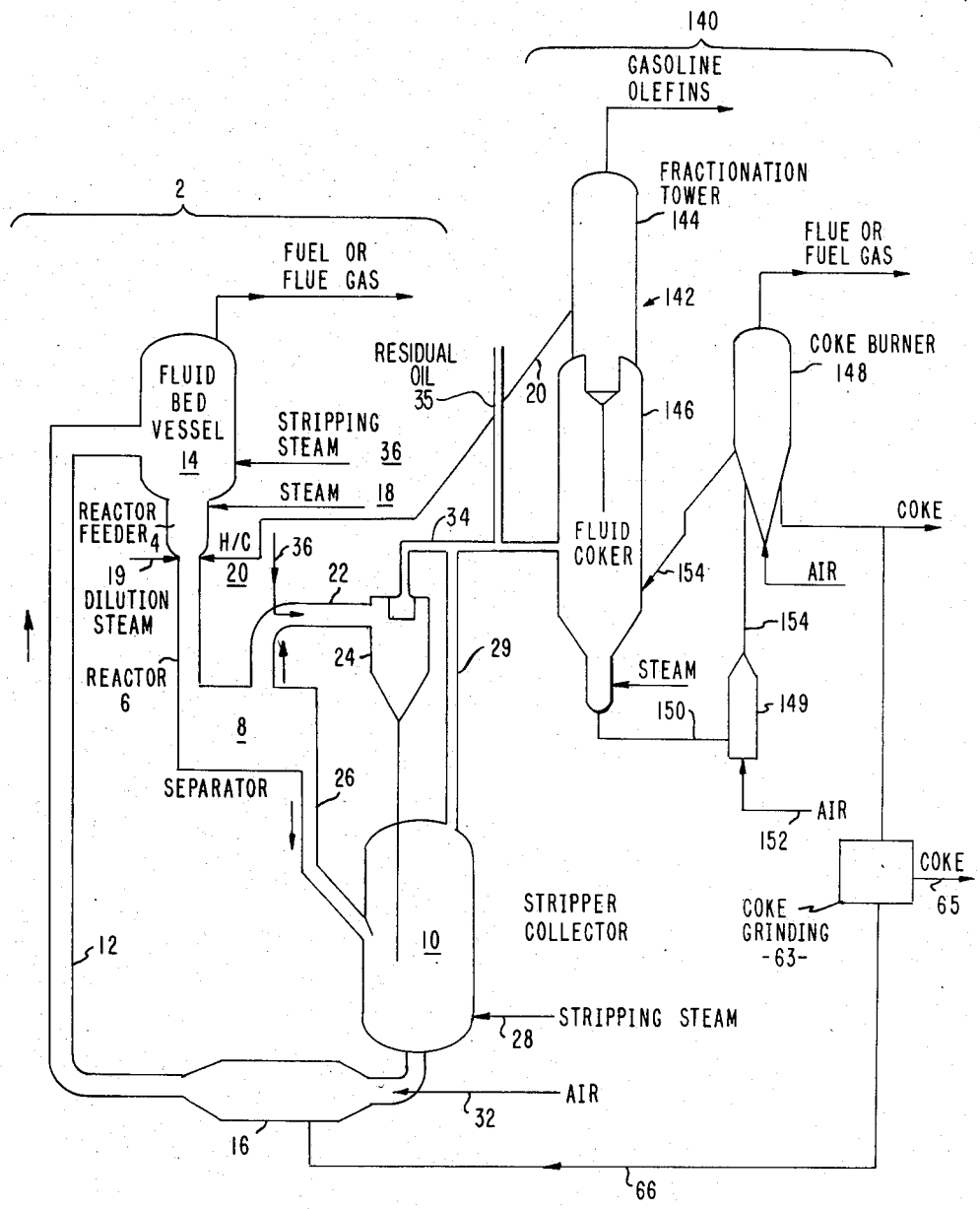
FIG. 2 is a modification and further embodiment of the combination fluid coker and thermal regenerative cracking (TRC) process of the invention.

The process as seen in FIG. 2 is a modification of the process of FIG. 1.

Therein, the olefin production system 2 is essentially the same as that in FIG. 1 and like elements have like reference numbers. The coking system 140 differs in that a combined coking vessel and fractionator 142 are provided with the coking vessel 146 arranged integrally with the fractionation tower 144. The coking system also includes a coking burner 148 and a combustor heater 149.

The process of the system set forth in FIG. 2 proceeds essentially the same as the process in FIG. 1. The solids to hydrocarbon ratio in the reactor 6 is 5 to 60 and the temperature of the hydrocarbon entering the reactor 6 from the fractionator tower 144 is at a temperature between 300° and 600° F. The residence time in the reactor is 0.05 to 0.50, the pressure is 0 to 300 psig and the cracking temperature is 1200° F. to 1600° F. The product leaving overhead from separator 8 in line 22 is at a temperature of 1200° F. to 1600° F. and is initially quenched by conventional quench oil to 1200° F.-1300° F. The solids separated in separator 8 are at a temperature of 1200° F.-1600° F. and are delivered to the stripper—collector 10, where stripping gas entering through line 28 strips hydrocarbon from the particules and delivers the stripped hydrocarbon through line 29 to line 34. Residual oil at a temperature between 100° F. and 700° F. is delivered through line 35 to line 34 to effect secondary quenching of the cracked product to approximately 500° F.-1000° F. The quenched product from line 34 is delivered directly to the coking vessel 146 from which the coke particles are taken through line 150 to be heated in the heater 148 by combustion with air entering through line 152. The heated product is delivered through line 154 to the coke drum 148 and returned to the coker 146 while the heavy coke product is returned through a line 66 to the entrained bed heater 16.

Figure 3:
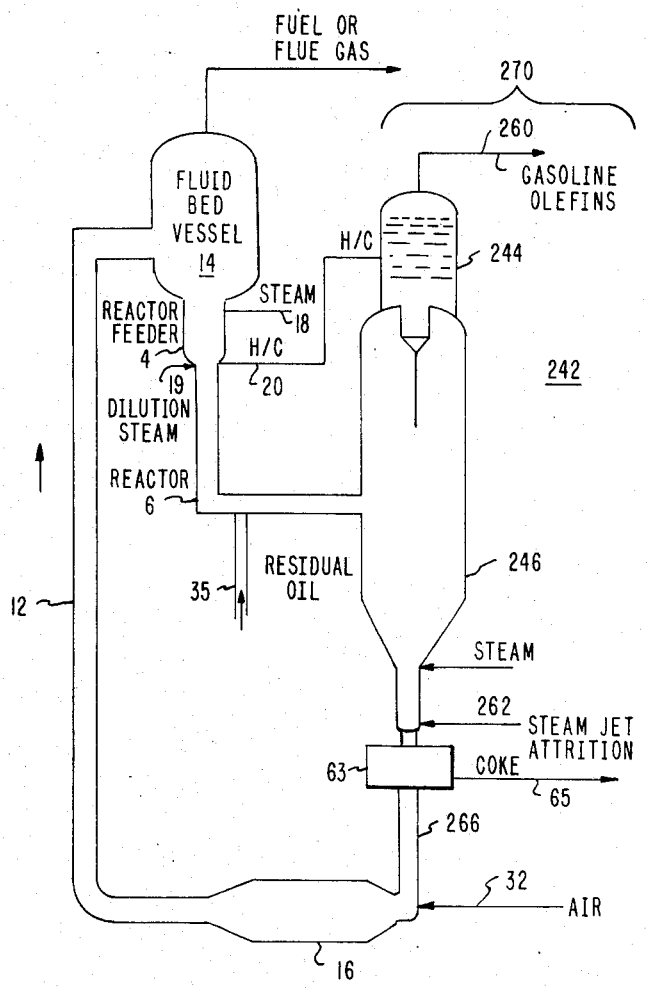
FIG. 3 is a modified embodiment of the basic coker-TRC thermal cracking process for generating olefins.

The modification of the present process seen in FIG. 3 is a variation of the basic process however, the residual oil is the sole quenching material and coke produced from the residual oil provides the source for both heat of the reactor and also acts as the heat carrier. The particulate material entering the reactor is the coke produced in the coking process 270.

The olefin cracking system is again comprised of the reactor 6, reactor feeder 4, the entrained bed heater 16, transport line 12 and fluid bed vessel 14. The coking system 270 is comprised of a integrated apparatus 242 of a coking vessel 246 and a fractionation tower 244.

In the embodiment of FIG. 3, the coked material is partially combusted in the entrained bed heater 16 and thereafter delivered to the fluid bed vessel 14 at a temperature of 1200° to 1800° F. The hot coke particles pass through the reactor feeder 4 into the reactor 6 for instantaneous mixing with the hydrocarbon which is delivered through line 20 to the reactor feeder 4 from the fractionation tower 244 at 300° F.-600° F. Cracking conditions are a residence time of 0.05 to 0.50 seconds, a pressure of 0 to 300 psig, and a temperature of 1200° F. to 1600° F. Rather than a separator, the solids and cracked product are instantly quenched with residual oil entering the system through line 35. The quenched olefin product is reduced in temperature from the cracking temperature to a temperature between 1200° F. and 900° F. and delivered to the coker 246 which is maintained at approximately 900° F.-1200° F. The olefins and gasoline products pass upwardly through the fractionation tower 242 wherein gasoline and olefins are taken overhead through line 260 for separation and collection downstream in conventional equipment. The coker 246 is provided with an assembly of jet attriters 262 at the bottom to insure that the coke is maintained in a particulate state.

The particulate coke is passed through line 266 to the entrained bed heater 16 wherein air is delivered through line 32 to combust a portion of the coke and elevate the remaining coke particles to a temperature of 1200° F. to 1600° F. The heated particles are delivered through line 12 to the fluid bed vessel 14 and passed to the reactor 6 through the reactor feeder 4.

As a result of the coking in the presence of a cracked gas containing olefins, the coke produced is purer by virtue of the absence of much of the sulfur typically found in coke made by conventional coking processes.

Figure 4:
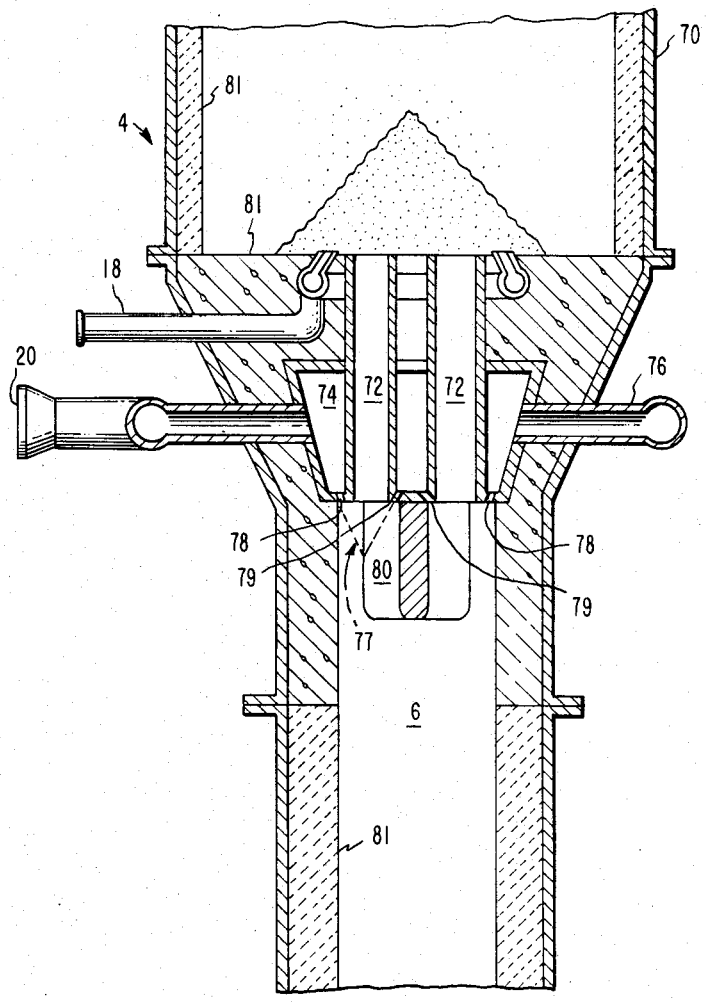
FIG. 4 is a sectional elevational view of the reactor feeder in a thermal regenerative cracking system.

The reactor feeder of the TRC processing system is particularly well suited for use in the system due to the capacity to rapidly admix hydrocarbon feed and particulate solids. As seen in FIG. 4, the reactor feeder 4 delivers particulate solids from a solids receptacle 70 through vertically disposed conduits 72 to the reactor 6 and simultaneously delivers hydrocarbon feed to the reactor 6 at an angle into the path of the particulate solids discharging form the conduits 72. An annular chamber 74 to which hydrocarbon is fed by a toroidal feed line 76 terminates in angled openings 78. A mixing baffle or plug 80 also assists in effecting rapid and intimate mixing of the hydrocarbon feed and the particulate solids. The edges 79 of the angled openings 78 are preferably convergently beveled, as are the edges 79 at the reactor end of the conduits 72. In this way, the gaseous stream from the chamber 74 is angularly injected into the mixing zone and intercepts the solids phase flowing from conduits 72. A projection of the gas flow would form a cone shown by dotted lines 77, the vortex of which is beneath the flow path of the solids. By introducing the gas phase angularly, the two phases are mixed rapidly and uniformly, and form a homogeneous reaction phase. The mixing of a solid phase with a gaseous phase is a function of the shear surface between the solids and gas phases, and the flow area. As ratio of shear surface to flow area (S/A) of infinity defines perfect mixing; poorest mixing occurs when the solids are introduced at the wall of the reaction zone. In the system of the present invention, the gas stream is introduced annularly to the solids which ensures high shear surface. By also adding the gas phase transversely through an annular feed means, as in the preferred embodiment, penetration of the phases is obtained and even faster mixing results. By using a plurality of annular gas fed points and a plurality of solid feed conduits, even greater mixing is more rapidly promoted, since the surface to area ratio for a constant solids flow area is increased. Mixing is also a known function of the L/D of the mixing zone. A plug creates an effectively reduced diameter D in a constant L, thus increasing mixing.

The plug 80 reduces the flow area and forms discrete mixing zones. The combination of annular gas addition around each solids feed point and a confined discrete mixing zone greatly enhances the conditions for mixing. Using this preferred embodiment, the time required to obtain an essentially homogenous reaction phase in the reaction zone is quite low. Thus, this preferred method of gas and solids addition can be used in reaction systems having a residence time below 1 second, and even below 100 milliseconds.

Because of the environment of the reactor 6 and reactor feeder 4, the walls are lined with an inner core 81 of ceramic material. The detail of the reactor feeder is more fully described in U.S. Pat. No. 4,388,187, which is incorporated herein by reference.

Figure 5:
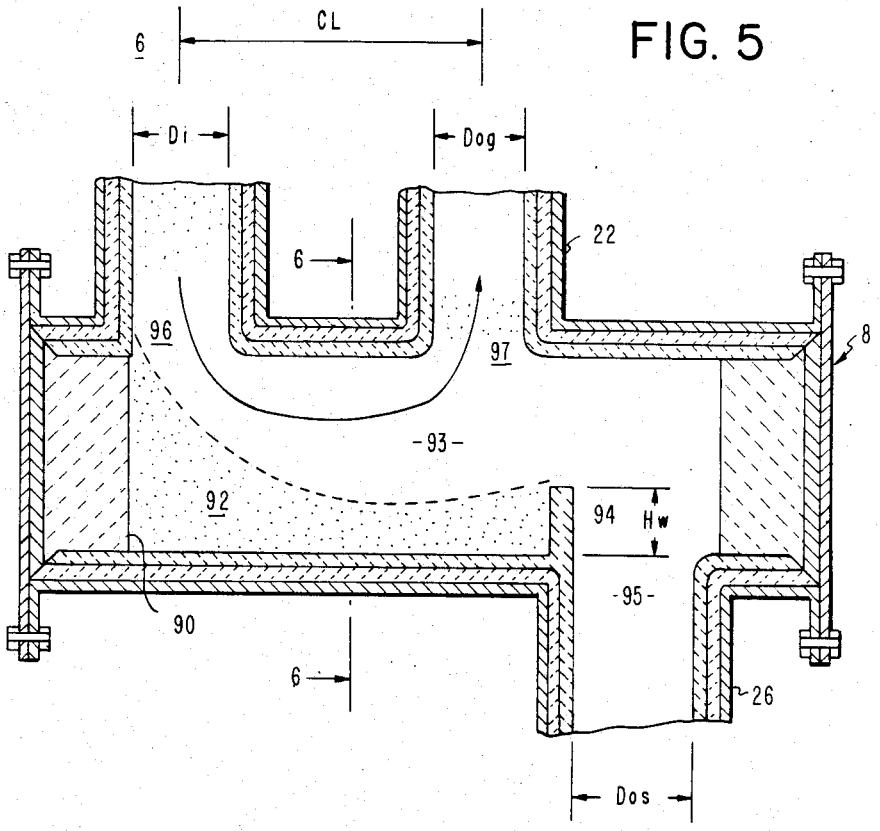
FIG. 5 is a sectional elevational view of the separator of the thermal regenerative cracking system.

The separator 8 ofthe TRC system seen in FIG. 5, can also be relied on for rapid and discrete separation of cracked product and particulate solids discharging from the reactor 6. The inlet to the separator 8 is directly above a right angle corner 90 at which a mass of particulate solids 92 collect. A weir 94 downstream from the corner 90 facilitates accumulation of the mass of solids 92. The gas outlet 22 of the separator 8 is oriented 180° from the separator gassolids inlet 96 and the solids outlet 26 is directly opposed in orientation to the gas outlet 22 and downstream of both the gas outlet 22 and the weir 94. In operation, centrifugal force propels the solid particles to the wall opposite inlet 96 of the chamber 93 while the gas portion having less momentum, flows through the vapor space of the chamber 93. Initially, solids impinge on the wall opposite the inlet 96 but subsequently accumulate to form a static bed of solids 92 which ultimately form in a surface configuration having a curvilinear arc of approximately 90° of a circle. Solids impinging upon the bed 92 are moved along the curvilinear arc to the solids outlet 95, which is preferably oriented for downflow of solids by gravity. The exact shape of the arc is determined by the geometry of the particular separator and the inlet stream parameters such as velocity, mass flowrate, bulk density, and particle size. Because the force imparted to the incoming solids is directed against the static bed 92 rather than the separator 8 itself, erosion is minimal. Separator efficiency, defined as the removal of solids from the gas phase leaving through outlet 97 is, therefore, not affected adversely by high inlet velocities, up to 150 ft./sec., and the separator 8 is operable over a wide range of dilute phase densities, preferably between 0.1 and 10.0 lbs./ft$^3$. The separator 8 of the present invention achieves efficiencies of about 80%, although the preferred embodiment, can obtain over 90% removal of solids.

It has been found that separator efficiency is dependent upon separator geometry, and more particularly, the flow path must be essentially rectangular, and there is an optimum relationship between the height H and the sharpness of the U-bend in the gas flow.

It has been found that for a given height H of chamber 93, efficiency increases as the 180° U-bend between inlet 96 and outlet 97 is brought progressively closer to inlet 96. Thus, for a given H the efficiency of the separator increases as the flow path decreases and, hence, residence time decreases. Assuming an inside diameter $D_i$ of inlet 96, the preferred distance CL between the centerlines of inlet 96 and outlet 97 is not greater than 4.0 $D_i$, while the most preferred distance between said centerlines is between 1.5 and 2.5 $D_i$. Below 1.5 $D_i$ better separation is obtained but difficulty in fabrication makes this embodiment less attractive in most instances. Should this latter embodiment be desired, the separator 8 would probably require a unitary casting design because inlet 96 and outlet 97 would be too close to one another to allow welded fabrication.

It has been found that the height of flow path H should be at least equal to the value of $D_i$ or 4 inches in height, whichever is greater. Practice teaches that if H is less than $D_i$ or 4 inches the incoming stream is apt to disturb the bed solids 92 thereby reentraining solids in the gas product leaving through outlet 97. Preferably H is on the order of twice $D_i$ to obtain even greater separation efficiency. While not otherwise limited, it is apparent that too large an H eventually merely increases residence time without substantive increases in efficiency. The width W of the flow path is preferably between 0.75 and 1.25 times $D_i$ most preferably between 0.9 and 1.10 $D_i$.

Outlet 97 may be of any inside diameter. However, velocities greater than 75 ft./sec. can cause erosion because of residual solids entrained in the gas. The inside diameter of outlet 97 should be sized so that a pressure differential between the stripping vessel 10 shown in FIG. 1 and the separator 8 exist such that a static height of solids is formed in solids outlet line 26. The static height of solids in line 26 forms a positive seal which prevents gases from entering the stripping vessel 10. The magnitude of the pressure differential between the stripping vessel 10 and the separator 8 is determined by the force required to move the solids in bulk flow to the solids outlet 95 as well as the height of solids in line 26. As the differential increases the net flow of gas to the stripping vessel 10 decreases. Solids, having gravitational momentum, overcome the differential, while gas preferentially leaves through the gas outlet.

Figure 6:
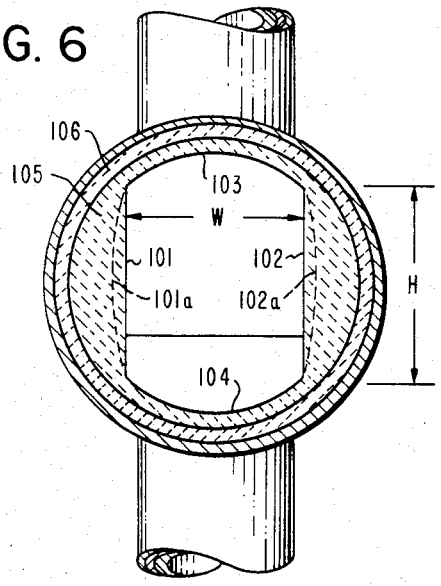
FIG. 6 is a sectional view through line 6—6 of FIG. 5.

FIG. 6 shows a cutaway view of a the separator along section 6—6 of FIG. 5. It is essential that longitudinal side walls 101 and 102 should be rectilinear, or slightly arcuate as indicated by the dotted lines 101*a* and 102*a*. Thus, the flow path through the separator 8 is essentially rectangular in cross section having a height H and width W as shown in FIG. 6. The embodiment shown in FIG. 6 defines the geometry of the flow path by adjustment of the lining width for walls 101 and 102. Alternatively, baffles, inserts, weirs or other means may be used. In like fashion the configuration of walls 103 and 104 transverse to the flow path may be similarly shaped, although this is not essential.

The separator shell and manways are preferably lined with erosion resistent linings 105, which may be required if solids at high velocities are encountered. Typical commercially available materials for erosion resistent lining include Carborundum Precast Carbofrax D, Carborundum Precast Alfrax 201 or their equivalent. A thermal insulation lining 106 may be placed between the shell and the lining 105 and between the manways and their respective erosion resistent linings when the separator is to be used in high temperatures service. Thus, process temperatures above 1500° F. (870° C.) can be used.

The detail of the separator 8 is more fully described in U.S. Pat. No. 4,288,235 which is incorporated herein by reference.

The following examples illustrate the benefits of the various processes of the invention. All examples are based on producing 100,000,000 pounds per year of pure ethylene, using 8000 hours for the year.

EXAMPLE 1

In accordance with the process of FIG. 1, if 90,400 pounds/hr of residual oil (ARABIAN HEAVY) at 10° F. are delivered through line 35 to the system, 32,900 pounds per hour of dilution steam at 1000° F. are delivered through line 19 to the reactor 6 and the following conditions are set:

| | |
|---|---|
| Reactor (6) Temperature | 1500° F. |
| Reactor (6) Pressure | 20 psig |
| Reactor (6) residence time | 0.2 sec. |
| Solids to Olefin H/C feed (line 20), weight ratio | 25.6 |
| Solids Temperature (vessel 14) | 1700° F. |
| Fractionation Tower temperature | |
| TOP | 350° F. |
| BOTTOM | 700° F. |
| Primary Quench (line 22) | 1300° F. |

65,800 pounds per hour of hydrocarbon from the fractionation tower 42 will be delivered to the reactor 6 at 600° F. resulting in the following yield in pounds per hour:

| | |
|---|---|
| $C_4$ and lighter | 40,400 |
| Gasoline | 24,400 |
| Coke | 16,400 |

The system will consume 16,400 pounds per hour of coke.

EXAMPLE 2

In accordance with the process of FIG. 2, if 140,250 pounds/hr of residual oil (ARABIAN HEAVY) at 300° F. are delivered through line 35 to the system, 34,720 pounds per hour of dilution steam at 1000° F. are delivered through line 19 to the reactor 6 and the following conditions are set:

| | |
|---|---|
| Reactor (6) temperature | 1500° F. |
| Reactor (6) pressure | 20 psig |
| Reactor (6) residence time | 0.2 sec. |
| Solids to Olefin H/C feed (line 20), weight ratio | 25.5 |
| Solids temperature (vessel 14) | 1700° F. |
| Coker (146) temperature | 950° F. |
| Fractionation tower temperature Top | 350° F. |
| Primary quench | 1300° F. |

69,440 pounds per hour of hydrocarbon from the fractionation tower 144 will be delivered to the reactor 6 at 600° F. resulting in the following yield in pounds per hour:

| | |
|---|---|
| $C_4$ and lighter | 55,350 |
| Gasoline | 27,850 |
| Coke | 30,010 |

The system will consume 19,040 pounds per hour of coke.

EXAMPLE 3

In accordance with the process of FIG. 3 if 140,250 pounds/hr of residual oil (ARABIAN HEAVY) at 260° F. are delivered through line 35 to the system 34,720 pounds per hour of dilution steam at 1000° F. are delivered through line 19 to the reactor 6 and the following conditions are set:

| | |
|---|---|
| Reactor (6) temperature | 1300° F. |
| Reactor (6) pressure | 20 psig |
| Solids to Olefin H/C feed (line 20), weight ratio | 14.6 |
| Solids temperature (vessel 14) | 1600° F. |
| Coker (246) temperature | 1000° F. |
| Fractionation Tower temperature Top | 350° F. |

69,440 pounds per hour of hydrocarbon from the fractionation tower 244 will be delivered to the reactor 6° at 600° F. resulting in the following yield in pounds per hour:

| | |
|---|---|
| $C_4$ and lighter | 55,350 |
| Gasoline | 27,850 |
| Coke | 35,800 |

The system will consume 21,150 pounds per hour of coke.

We claim:

1. A process for producing olefins and liquid hydrocarbon fuels from heavy hydrocarbon residual oil feed comprising:

(a) delivering a hydrocarbon side cut from a coker fractionation tower to a tubular thermal regenerative cracking reactor feeder;

(b) delivering hot particulate solids to the tubular thermal regenerative cracking reactor feeder;

(c) delivering the mixed hot particulate solid and the hydrocarbon side cut from the coker fractionation tower to the tubular thermal regenerative cracking reactor;

(d) separating the cracked effluent and the particulate solids discharged from the tubular thermal regenerative cracking reactor;

(e) injecting the heavy hydrocarbon residual oil feed into the cracked effluent stream to quench the cracked effluent stream;

(f) delivering the quenched cracked effluent stream to the coker fractionation tower; and (g) producing coke from the bottoms of the coker fractionation tower.

2. A process as in claim 1, wherein the conditions in the reactor comprise a temperature of 1200° F. to 1600° F. and a residence time of 0.05 to 0.50 seconds.

3. A process as in claim 2, wherein the cracked effluent stream is quenched.to a temperature of 1200° F. to 1300° F. by conventional quench oil and then to about 700° F. by the residual oil quench.

4. A process as in claim 1, wherein the hydrocarbon feed and hot particulate solids are delivered to the tubular cracking reactor through a reactor feeder having vertical passages communicating with the tubular cracking reactor and the solids in a hot solids vessel, means for providing localized fluidizaton to the solids above the vertical passages and means for delivering the heavy hydrocarbon to the tubular reactor at an angle to the path of the particulate solids entering the tubular reactor.

5. A process as in claim 1, wherein the particulate solids and the cracked product gases are separated in a separator wherein the particulate solids or cracked product gases enter the separator through a separator inlet and change direction another ninety degrees to effect a one hundred and eighty degree reversal in direction from the entry direction; the particulate solids continue in the path oriented ninety degrees from the particulate solids—cracked product gas separator inlet and thereafter, the path of the particulate solids is directed downwardly.

6. A process as in claim 1, wherein the particulate solids and cracked product gases are separated in a separator comprising:

a chamber for rapidly disengaging about 80% of the particulate solids from the incoming mixed phase stream, said chamber having approximately rectilinear longitudinal side walls to form a flow path of height H and width W approximately rectangular in cross section, said chamber also having a mixed phase inlet of inside width $D_i$ a gas outlet and a solids outlet, said inlet being at one end of the chamber and disposed normal to the flow path the height H of which is equal to at least $D_i$ or 4 inches, whichever is greater, and the width W is no less than 0.75 $D_i$ but no more than 1.25 $D_i$ of which said solids outlet being at the opposite end of the chamber and being suitably arranged for downflow of discharged solids by gravity, and said gas outlet being therebetween at a distance no greater than 4 $D_i$ from the inlet as measured between respective centerlines and oriented to effect a 180° change in direction of the gas whereby resultant centrifugal forces direct the solid particles in the incoming stream toward a wall of the chamber opposite to the inlet forming thereat and maintaining an essentially static bed defining a curvilinear path of an arc of approximately 90° of a circle for the outflow of solids to the solids outlet.

7. A process as in claim 1, wherein a portion of the coke produced from the bottoms of the fractionation tower is burned in the presence of the particulate solids separated from the cracked effluent to provide heat for cracking in the tubular thermal regenerative cracking reactor.

8. A process for producing olefins and liquid hydrocarbon fuels from heavy hydrocarbon feed comprising:

(a) delivering a side cut from a coker fractionation tower to a tubular thermal regenerative cracking reactor feeder;

(b) delivering hot particulate solids to the tubular thermal regenerative cracking reactor feeder;

(c) delivering the mixed hot particulate solids and hydrocarbon feed to the tubular thermal regenerative cracking reactor;

(d) separating the cracked effluent and the particulate solids discharged from the tubular thermal regenerative cracking reactor;

(e) injecting residual oil into the cracked effluent stream to quench the cracked effluent;

(f) delivering the quenched cracked effluent stream to a said fluid coker—fractionation tower; and (g) producing a fuel gas and a coke by-product from the product produced in the fluid coker.

9. A process as in claim 8, wherein the condition in the reactor comprise a temperature of 1500° F.; and a residence time of 0.2 seconds.

10. A process is in claim 8, further comprising the step of burning a portion of the coke produced from the fluid coker int he presence of the solids separated from the cracked effluent, to heat the solids to provide the heat for cracking.

11. A process for producing olefins and light hydrocarbon fuels from heavy hydrocarbon comprising the steps of:

(a) delivering a hydrocarbon fraction from a fluid coker fractionation tower to a tubular thermal regenerative cracking reactor feeder;

(b) delivering hot particulate solids to the tubular thermal regenerative cracking reactor feeder;

(c) delivering the mixed hot particulate solids and hydrocarbon feed to the tubular thermal regenerative cracking reactor;

(d) cracking the hydrocarbon fraction;

(e) quenching the cracked product and the particulate solids form the tubular thermal regenerative cracking reactor with heavy hydrocarbon;

(f) delivering the quenched cracked product and particulate solids to the coker of a said fluid coker—fractionation tower unit;

(g) producing coke in the coker of the fluid coker—fractionation unit; and (h) passing the gaseous product from the coker to the fractionator.

12. A product as in claim 11, further comprising the step of combusting, in the presence of the particulate solids, a portion of the coke produced int he coker, to provide heat for the tubular thermal regenerative cracker.

13. A process as in claim 12, comprising the cracking condition of a cracking temperature of 1200° F. to 1600° F., a residence time of 0.05 to 0.50 seconds.

14. A process as in claim 13, wherein the coker is maintained at a temperature of about 1000° F.

15. A process as in claim 1, wherein the heavy hydrocarbon is residual oil.

16. A process as in claim 12, wherein the heavy hydrocarbon is residual oil.

* * * * *